United States Patent [19]

Seligmann

[11] 4,108,524

[45] Aug. 22, 1978

[54] ELECTRICAL CONNECTION ASSEMBLY AND CONNECTORS THEREFOR

[75] Inventor: Peter Charles Seligmann, Lombardy East, South Africa

[73] Assignee: Aeci Limited, Johannesburg, South Africa

[21] Appl. No.: 806,828

[22] Filed: Jun. 15, 1977

[30] Foreign Application Priority Data

Sep. 27, 1976 [ZA] South Africa ..... 76/5757

[51] Int. Cl.[2] ..... H01R 11/08

[52] U.S. Cl. ..... 339/47 R; 339/244 R; 339/176 A

[58] Field of Search ..... 339/47 R, 47 C, 244 R, 339/244 B, 244 UC, 276 A, 255 RT, 256 RT

[56] References Cited

FOREIGN PATENT DOCUMENTS 942,506 11/1963 United Kingdom ..... 339/47 R 977,902 12/1964 United Kingdom ..... 339/244 R

*Primary Examiner*—Roy Lake
*Assistant Examiner*—E. F. Desmond
*Attorney, Agent, or Firm*—Cushman, Darby & Cushman

[57] ABSTRACT

A plug and socket connector and connection assembly formed by two mating plug and socket connectors. Each plug and socket connector comprises an insulator body of elastomeric material having a base partially encircled about its periphery by a wall extending vertically from the base and a peg extending vertically from the base. The peg is disposed in spaced relationship relative to the wall and defines an open socket between it and the wall. An electric contact pin is provided for each connector composed of the spirally wound core on the peg of the uninsulated terminal portion of an insulated lead wire positioned through the insulator body and its base. Each connector may comprise a plurality of pins, with corresponding pegs, if desired.

11 Claims, 4 Drawing Figures

ELECTRICAL CONNECTION ASSEMBLY AND CONNECTORS THEREFOR

This invention relates to an electrical connection assembly and connectors therefor and, more particularly, to an electrical connection assembly of identical plug and socket connectors and to such identical plug and socket connectors.

While there are many situations in which the present invention may be usefully employed, its use with reference to a mining environment will illustrate the need for yet another type of electrical connection means in an already crowded art. For instance in blasting with electro explosive devices, such as electric detonators, it is common practice to attach the leading wires from the detonators to the firing circuit wires by twisting them together. While this method gives a reliable connection if correctly done, it is time consuming and can lead to errors if the wires to be joined are not correctly identified. It also makes connections which are difficult to insulate in such a way that accidental contact with other wires, the ground or metallic installations in the working place are prevented. It would therefore be advantageous if means could be provided whereby the wires could be quickly, reliably and correctly connected together and, at the same time, be insulated from accidental contacts.

It will be appreciated that the connection means will either be destroyed when the blast is fired or be engulfed in the mass of broken rock so as to render uneconomic its recovery for re-use. The cost of such connection means must therefore be acceptable for 'throw-away' usage after one operation. Those skilled in the arts of electrical engineering will be familiar with many and various plugs and sockets or similar devices designed for connecting wires. There are usually made for repeated use. Such devices usually consist of an assemblage of electrical contact parts adapted to mate with one another on the one hand and to be attached to the wires by soldering, crimping, wrapping or the like on the other. The cost of producing such known devices and attaching them to the wires renders them too expensive for the purposes envisaged herein.

It is an object of this invention to provide an electrical connecting means which is inexpensive to manufacture. It is a further object of the invention to form the electrical contact parts from the wires themselves to eliminate the additional joining operations inherent in known electrical connecting devices. It is a further object of the invention to ensure that the electrical connections are insulated from accidental contact with other wires or external objects without requiring additional operations.

Accordingly, this invention provides an electrical connection assembly of two identical plug and socket connectors, each connector comprising a. an insulator body of an elastomeric material having a base partially encircled around its periphery by a wall extending vertically therefrom and a peg extending vertically from the base, the peg being disposed in spaced relationship relative to the wall and defining an open socket therebetween, and b. an electrical contact pin connected of the spirally wound core on the peg of the terminal portion of an insulated lead wire positioned through the insulator body and its base, wherein the pin of each connector is plugged into the open socket of the opposed connector and the walls exert lateral resilient forces which urge the pins towards each other to establish an interference fit, the interstices between the spirals of the core on each pin providing meshing engagement means, and the walls shield the engaged pins.

The peg may be of an elastomeric material which is integral with the insulator body of the connector or it may be of metal or a metallic alloy and be secured to the elastomeric material of the insulator body of the connector.

The protective shield around the engaged pins of the assembly provided by the walls of the two connected identical plug and socket connectors insures the electrical connection against damage by foreign objects. The shield also insulates the electrical connection from unintentional contact with other wires. Further features of the invention include a wall, which encircles half the periphery of the base of the insulator body of each connector and which may also comprise stop means to abut the surface of the base of the insulator body of the opposed connector when two connectors are plugged into each other to form an electrical connection assembly. Such walls will provide an effective enclosure within which to encase the engaged pins of the two connectors of the electrical connection assembly of the invention.

This invention includes a plug and socket connector comprising a. an insulator body of an elastomeric material having a base partially encircled around its periphery by a wall extending vertically therefrom and a peg extending vertically from the base, the peg being disposed in spaced relationship relative to the wall and defining an open socket therebetween, and b. an electrical contact pin composed of the spirally wound core on the peg of the terminal portion of an insulated lead wire positioned through the insulator body and its base.

The invention further includes plug and socket connectors as described above, each of which has two electrical contact pins adjacent each other. The two pins are so disposed relative to the wall that they define an open socket between them and the wall. The two pin connectors have all the essential and the alternative elements which may be required in the single pin connectors.

The elastomeric material suitable for the electrical connection assembly and the identical plug and socket connectors of this invention may be, for example, a synthetic material such as polyethylene or polypropylene or a natural material such as a hard rubber.

An embodiment of the invention is described below, by way of example and not of limitation, with reference to the accompanying drawings, in which FIG. 1 illustrates an exterior view of an electrical connection assembly according to the invention;

Figure 1:
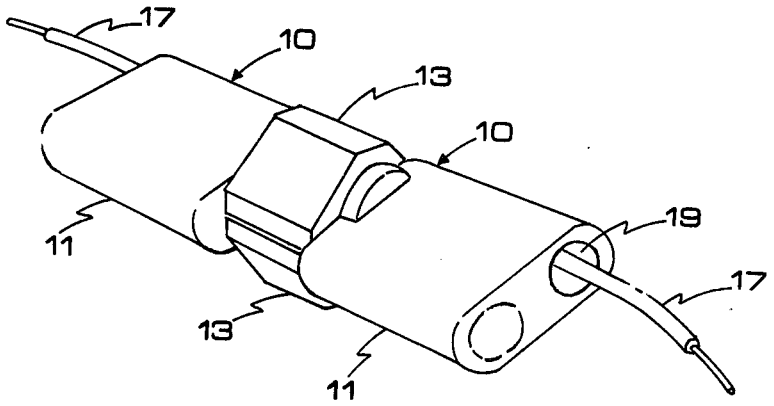
Figure 3:
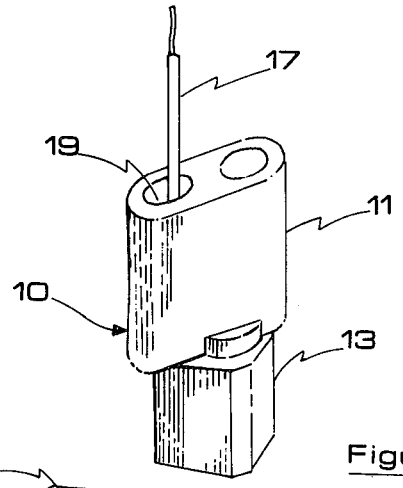
FIG. 3 is a rear view of a plug and socket connector according to the invention.
Figure 4:
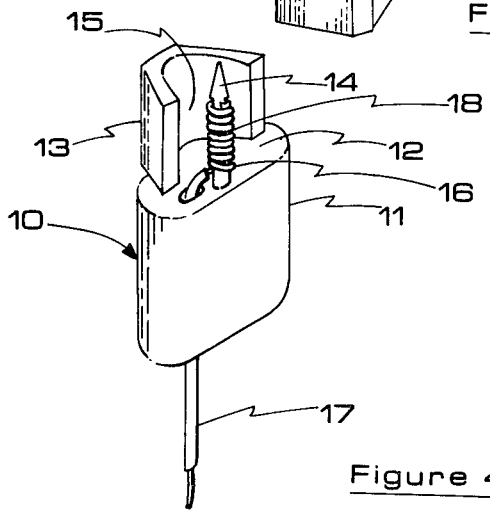
FIG. 4 is a front view of the connector of FIG. 3.

The same reference numerals designate like parts. As shown in FIG. 1, two identical plug and socket connectors 10 are plugged into each other to form an electrical connection assembly. The connector 10 is shown in FIGS. 3 and 4 and has an insulator body 11 of polyethylene. The base 12 of body 11 is partially encircled around its periphery by the vertical wall 13 and, in this embodiment, the wall approximates to a semi-circular wall. The vertical peg 14 of polyethylene is integral with the body 11 and is disposed in spaced relationship relative to wall 13 whereby an open socket 15 is delineated by the peg 14 and the semi-circular wall 13 which is opposite and partially surrounds the peg 14. The spirally wound core 16 of the terminal portion of insulated lead wire 17 on the peg 14 constitutes the electrical contact pin 18. Lead wire 17 is accommodated in this connector in a passage 19 provided in the body 11 and penetrates the base 12.

Figure 2:
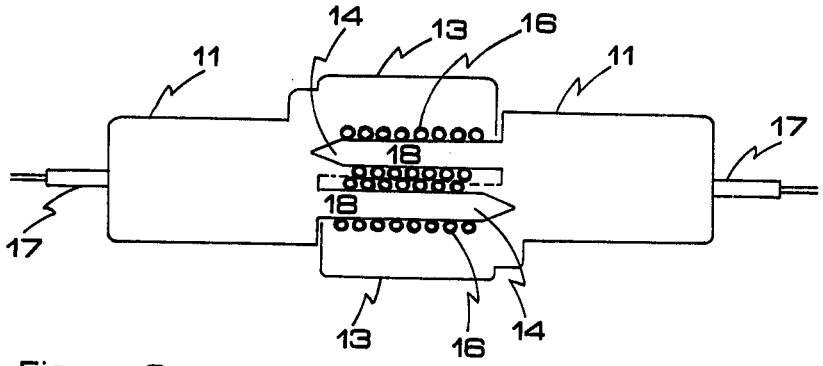
FIG. 2 is an enlarged view of a diagram to illustrate the engagement of the electrical contact pins.

When two opposed identical plug and socket connectors 10 in, say, the positions indicated by FIGS. 3 and 4 are connected in an electrical connection assembly, the respective pins 18 are plugged into the respective open sockets 15 facing them until the top of each wall 13 abuts the surface of each base 12. The walls 13 exert lateral resilient forces in the connection assembly and the interstices between the spirals of the cores 16 provide meshing engagement of the two pins 18 as shown in FIG. 2, which engagement resists any reasonable forces tending to disconnect the two connectors 10. In this assembly the walls 13 completely shield the two engaged pins 18 as is shown in FIG. 1.

A quantity in excess of 3,000 plug and socket connectors of polyethylene and having pegs of metal have been used in routine mine blasting operations. It was established that quick, effective and reliable electrical connection assemblies were made by miners working in underground conditions.

A trial involving 2,000 plug and socket connectors was mounted in the course of an experimental blasting investigation. It was found that the connectors speeded up the operation by reducing the time required to check 50 circuits of 2 detonators from about 30 minutes to about 10 minutes. Connecting-up was reported by the operators to be easy and no bad connections were found in the 1,000 pairs of connections which were made.

I claim:

1. Plug and socket connector comprising a. an insulator body of an elastomeric material having a base partially encircled around its periphery by a wall extending vertically therefrom and a peg extending vertically from the base, the peg being disposed in spaced relationship relative to the wall and defining an open socket therebetween, and b. an electrical contact pin composed of the spirally wound core on the peg of the bare terminal portion of an insulated lead wire positioned through the insulator body and its base.

2. A plug and socket connector as recited in claim 1 comprising a pair of substantially identical electrical contact pins and associated pegs.

3. A connector as recited in claim 1 wherein said elastomeric material is selected from the group consisting of polyethylene, polypropylene, and hard rubber.

4. A connector as recited in claim 1 wherein the peg is secured to the elastomeric material of the insulator body and is selected from the group consisting of metals and metallic alloys.

5. An electrical connection assembly of two identical plug and socket connectors, each connector comprising (a) an insulator body of an elastomeric material having a base partially encircled around its periphery by a wall extending vertically therefrom and a peg, distinct from the wall, extending vertically from the base, the peg being disposed in spaced relationship relative to the wall and defining an open socket therebetween, and (b) an electrical contact pin composed of the spirally wound core on the peg of the bare terminal portion of an insulated lead wire positioned through the insulator body and its base, means for exerting lateral resilient forces which urge the pins of the connectors towards each other to establish an interference fit and for shielding the engaged pins, said means comprising the connectors walls, and means for providing meshing engagement between the pins, said means comprising the interstices between the spirals of the core on each pin.

6. Electrical connection assembly as claimed in claim 5 wherein the peg is of an elastomeric material integral with the insulator body of the plug and socket connector.

7. Electrical connection assembly as claimed in claim 5 wherein the wall encircles half the periphery of the base of the insulator body of the plug and socket connector.

8. Electrical connection assembly as claimed in claim 5 wherein the wall comprises stop means to abut the surface of the base of the insulator body of the opposed plug and socket connector.

9. An assembly as recited in claim 5 wherein each connector comprises two substantially identical electrical contact pins and associated pegs, pins of one connector in interfering meshing engagement with the pins of the other connector.

10. An assembly as recited in claim 5 wherein said elastomeric material is selected from the group consisting of polyethylene, polypropylene, and hard rubber.

11. An assembly as recited in claim 5 wherein the peg is secured to the elastomeric material of the insulator body and is selected from the group consisting of metals and metallic alloys.

* * * * *